United States Patent [19]

Ooyama et al.

[11] 3,934,693

[45] Jan. 27, 1976

[54] AUTOMATIC BANKING DEPOSIT RECEIVING AND HANDLING MACHINE

[75] Inventors: Kenichi Ooyama, Nagaokakyo; Syunsuke Matsuo, Muko, both of Japan

[73] Assignee: Omron Tateisi Electronics Co., Kyoto, Japan

[22] Filed: Aug. 13, 1974

[21] Appl. No.: 496,921

[30] Foreign Application Priority Data

Aug. 16, 1973 Japan ..... 48-91857

[52] U.S. Cl. ..... 194/4 R; 194/DIG. 26

[51] Int. Cl.[2] ..... G07F 7/10

[58] Field of Search ..... 194/4, DIG. 26; 235/61.7 B; 340/149 A

[56] References Cited

UNITED STATES PATENTS

| | | | |
|---|---|---|---|
| 3,038,157 | 6/1962 | Simjian | 194/DIG. 9 |
| 3,039,582 | 6/1962 | Simjian | 194/DIG. 9 |
| 3,056,132 | 9/1962 | Simjian | 194/4 E X |
| 3,648,020 | 3/1972 | Tateisi et al. | 194/DIG. 9 |
| 3,715,569 | 2/1973 | Hicks et al. | 194/DIG. 9 |

*Primary Examiner*—Robert B. Reeves
*Assistant Examiner*—Francis J. Bartuska
*Attorney, Agent, or Firm*—Christensen, O'Connor, Garrison & Havelka

[57] ABSTRACT

An automatic deposit receiving and handling machine into which all the bills a depositor intends to deposit can be put at one time, so that the time required for making a deposit is greatly reduced. When the bills have been placed on a tray provided for the purpose, access to the tray is prevented.

11 Claims, 4 Drawing Figures

AUTOMATIC BANKING DEPOSIT RECEIVING AND HANDLING MACHINE

This invention relates to an automatic deposit receiving and handling machine and more particularly to improvements in the speed and efficiency with which the machine receives and handles bank notes or bills presented to it by depositors.

There are known various types of deposit machines which automatically receive and handle deposits. The general arrangements of a known typical deposit machine are such that a depositor introduces into the machine his card and the money he wishes to deposit, whereupon the machine calculates the amount of money introduced, enters the credit into his account, records the deposit on the card, performs other necessary clerical work and returns the card to the depositor. In the known types of deposit machines, the depositor must introduce a plurality of bills or bank notes one by one into the machines, so that the more the bills to be introduced, the longer will be the time required for the introduction and subsequent handling of the bills within the machine. Since the depositor must stand in front of the machine for a long time with cash money in his hand, there is a danger of robbery and other illegal acts on the depositor.

Accordingly, it is one object of the invention to provide an improved deposit receiving and handling machine.

Another object of the invention is to provide a deposit receiving and handling machine in which the time required for receiving and handling deposits is greatly shortened.

Another object of the invention is to provide a deposit receiving and handling machine in which operation by a depositor for introducing paper money into the machine is much simplified.

Still another object of the invention is to provide a deposit receiving and handling machine in which many bills to be deposited can be introduced at one time into the machine without attracting much public attention.

In accordance with the invention, all of the bank notes or bills to be deposited are put into the machine at one time. A bill receiving tray is provided in the machine so that the depositor places all the bills piled up on the tray, whereupon access to the bills on the tray from outside the machine is prevented. Since all the bills to be deposited are placed on the tray at one time, it takes far less time than if the bills were put into the machine one by one as is usually the case with the prior art machines of the type.

If a card is used for making deposits, prior to the introduction of bills into the machine the depositor inserts his card into the machine, whereupon a card reader provided in the machine reads the information recorded on the card and checks the genuineness and validity of the card. If the card is recognized as genuine and valid, the depositor places bills on the tray. The arrangements may be such that normally access to the tray is prevented and upon recognition of genuineness and validity of the card access to the tray is allowed.

When the bills have been placed on the tray, access thereto from outside the machine is again prevented. The bills piled upon the tray are then removed therefrom one by one so as to be checked with respect to their genuineness and counted. The total value of the bills introduced is calculated and indicated in an indicator on the front panel of the machine. If the depositor recognizes agreement between the indicated value and the value of the money he has put into the machine, he allows the bills to be accepted by the machine. If disagreement occurs between the two values, or if the depositor wishes to cancel the deposit, the bills introduced are returned to the depositor.

When the bills have been accepted, the new balance is written on the card or a deposit slip or receipt is made and other necessary clerical work involved in the deposit such as rewriting the balance of the depositor's account is conducted. Finally the card is returned to the depositor with or without the deposit slip or receipt.

In accordance with the invention, all the bank notes or bills are put into the machine at one time and inside the machine those bills are successively and continuously handled so that the time required for depository of many bills becomes shorter and there is less chance of attracting public attention to a large amount of money than in the prior art deposit machines.

The invention will be explained in further detail with reference to the accompanying drawings, wherein.

Figure 1:
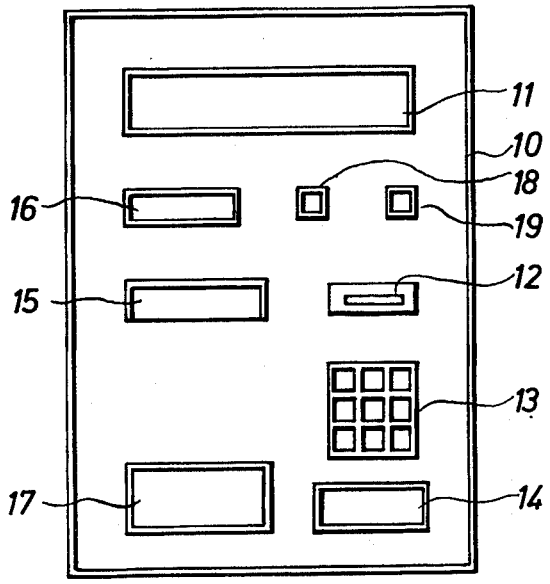
FIG. 1 is a front view of an automatic deposit receiving and handling machine of the invention.

Referring first to FIG. 1, there is shown an automatic deposit receiving and handling machine (which will be referred to simply as the "machine" hereinafter) having a front panel 10 in which there is formed an indicating window 11 in the upper portion in which instructions regarding the operations of the machine to be performed by the depositor are successively indicated. First, the indication is that the depositor should insert his card into a slot 12. When the card has been put into the slot 12, the window 11 indicates that the depositor should now input his secret number into the machine by means of a keyboard 13. When the depositor does this, whether the card is valid and whether the depositor is the proper holder of the card are checked on the basis of the information read from the card and the number input through the keyboard 13. If the card has been recognized as invalid or if the depositor has been recognized as an improper holder of the card, the card is delivered out of an outlet 14.

When the card has been recognized as valid and the depositor has been recognized as the proper holder thereof, an indication that the depositor should now place the bills he intends to deposit at one time piled on a tray 15 appears in the window 11. When the depositor has done this, the bills are checked with respect to genuineness and kind, and their total value is calculated and indicated in a window 16. If any of the bills is false, it is delivered out through an outlet 17.

If the indicated value in the window 16 agrees with the total value of the bills introduced, an indication that a deposit button 18 should be pressed appears in the window 11. If the two values disagree, the indication is that a cancel button 19 should be pressed. Also, if the depositor wishes to cancel the deposit, he may press the button 19.

When the deposit button 18 has been pressed, the bills introduced into the machine are now accepted and after necessary operations for depository have been finished, the card is returned through the outlet 14 together with a deposit slip or receipt. If the cancel button 19 is pressed, the bills introduced as well as the card are returned through the outlets 17 and 14, respectively. Thus the operations that a depositor must conduct for making a deposit and the receiving and handling of the deposit inside the machine have been finished.

Figure 3:
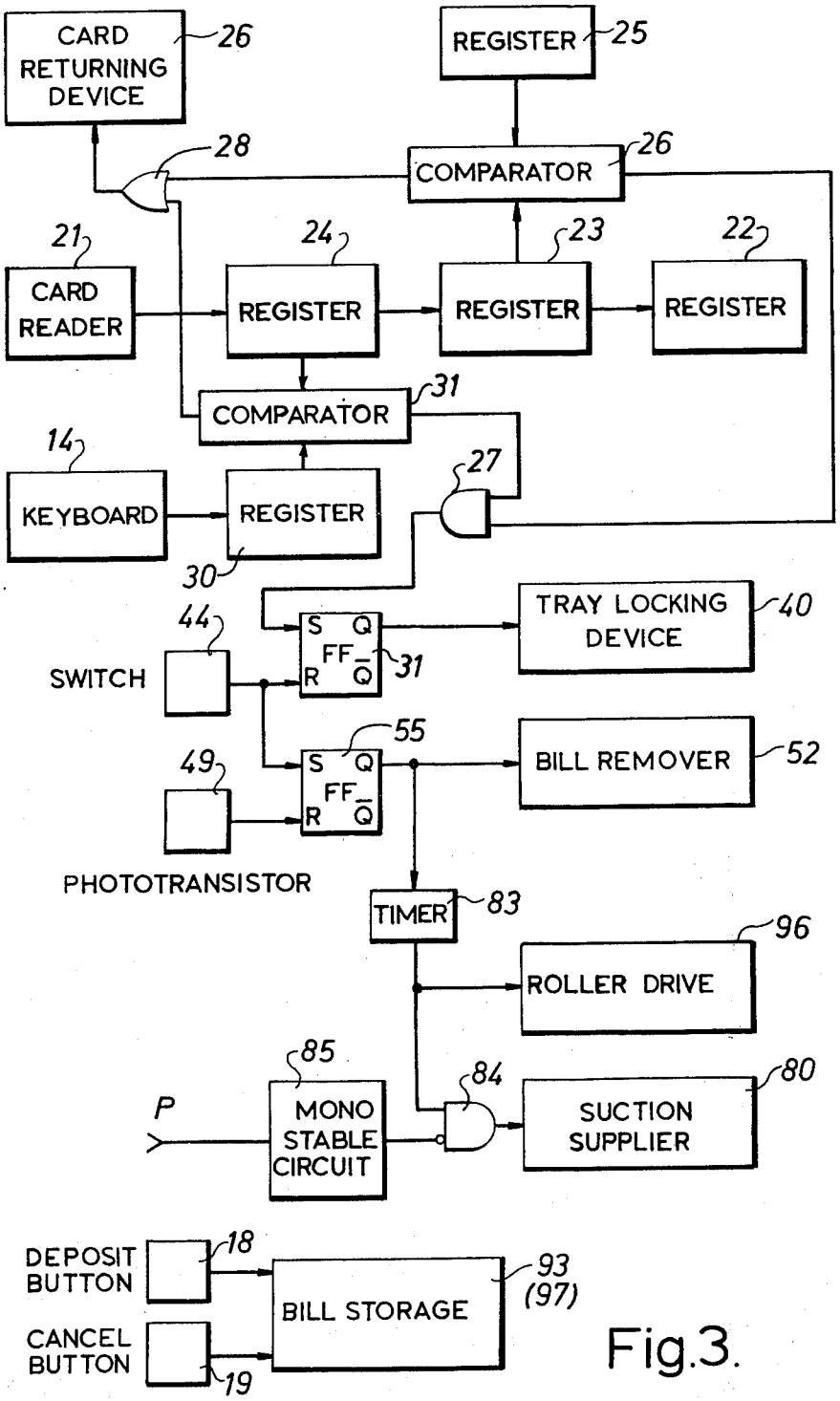
FIG. 3 is a block diagram of the electrical control circuit of the machine of the invention.

Now, turning to FIG. 3, the information on the card introduced through the inlet 12 is read by a card reader 21. The card information includes the secret number of the card, the bank number and the account number of the card owner, which the card reader applies to registers 22, 23 and 24, respectively. The bank number is previously stored in a register 25. A comparator 26 compares the bank number stored in the register 25 and the bank number read from the card and stored in the register 23. If the two numbers agree, the comparator 26 produces an output to be applied as one input to an AND element 27. If they disagree, the comparator applies a signal to an OR element 28, whereupon the OR element produces an output to actuate a card returning device 29 to return the card through the outlet 14.

When the depositor has entered his secret number into the machine by means of the keyboard 13, the secret number is stored in a register 30. A comparator 31 compares the numbers stored in the registers 24 and 30, and if the two numbers agree, the comparator 31 produces an output to be applied as a second input to the AND element 27. If there is no agreement between the two numbers, the comparator produces an output to be applied to the OR element 28 so that the output from the element causes the device 29 to return the card to the depositor in the same manner as previously mentioned. The output from the AND element 27 is applied as a set input to a fip-flop 31. A third input may be applied to the AND element 27 when the card has been recognized as genuine. When the flip-flop is set, it produces a set output to be applied to a tray locking device 40 to release it from its tray locking operation.

Figure 2:
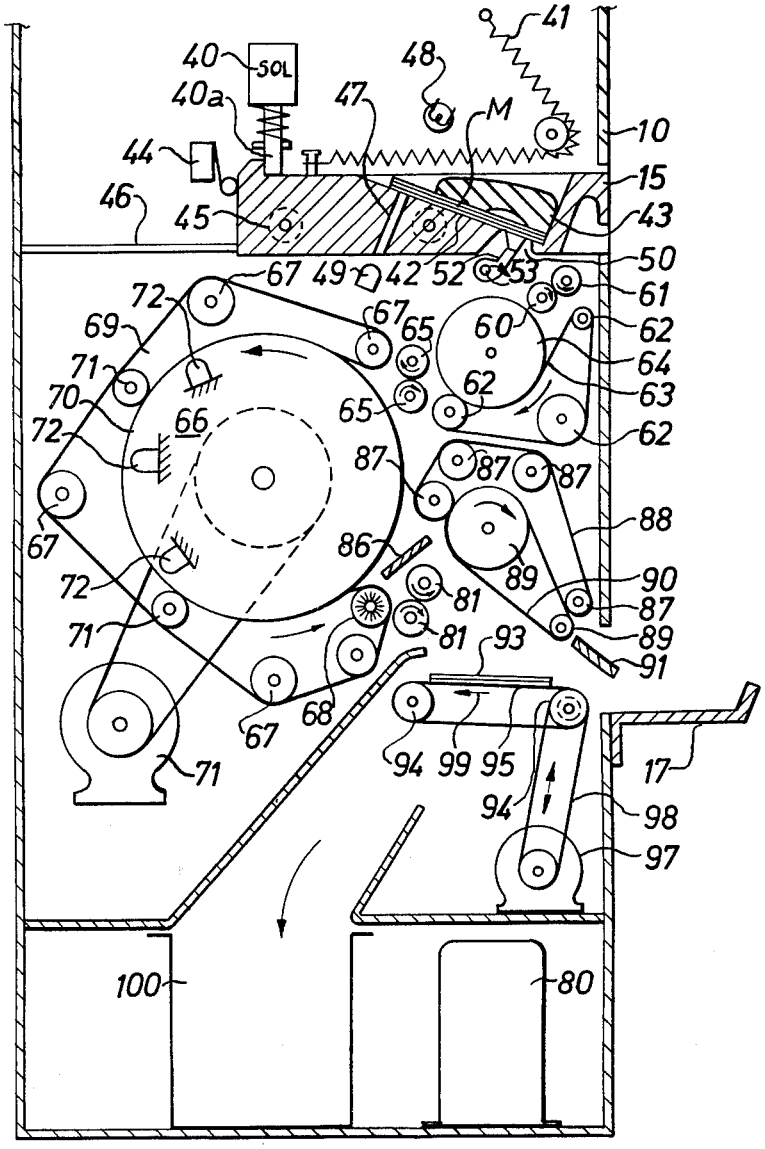
FIG. 2 is a side view of the interior mechanism of the invention.

As shown in FIG. 2, the device 40 comprises a solenoid, which is energized upon application of the set output from the flip-flop to the device 40 so that the plunger or stopper 40*a* that has until then been preventing the tray 15 from being drawn out of the front panel of the machine is pulled upward to release the tray 15. A spring 41 biases the tray 15 in the direction in which the tray 15 is drawn out of the front panel. Therefore, when the stopper 40*a* is pulled upward, the tray is drawin out by the force of the spring 41.

The tray is formed with an inclined surface 42, on which the depositor places all his bills M at one time and then after putting a weight 43 on the piled bills the depositor pushes the tray with the bills thereon into the machine as far as the inner end of the tray closes a limit switch 44, whereupon a reset signal is applied to the flip-flop 31. This causes the set output of the flip-flop to disappear so that the solenoid 40 is deenergized to project the plunger 40*a* to hold and lock the tray at the pushed-in position against the force of the spring 41. Under this condition the tray is completely enclosed inside the machine housing so that access to the bills M on the tray is prevented.

The tray is provided with rollers 45 which ride on guide rails 46 for smooth movement of the tray as it is pulled out of or pushed into the machine housing.

The tray is further provided with a through bore 47 at such a position of the tray that when the tray is pushed into the machine, a lamp 48 projects light through the bore 47 onto a phototransistor 49. However, if a bill is placed on the tray, it blocks the bore thereby preventing the light from the lamp from passing through the bore. If the light from the lamp once blocked again passes through the bore to be received by the phototransistor, the condition means that the bills on the tray have been removed therefrom in the manner to be described below.

In the lower portion of the inclined surface 42 of the tray there is formed a slot which has a width correspoinding to the width of the bills and communicates with a downwardly flared recess 50 opening at the under surface of the tray. In the recess 50 there is provided a bill remover 52 which removes the bills one by one from on the inclined surface 42 of the tray. The remover 52 is in the form of a sucking pipe which is swingable about a pivot 53 between upper and lower positions. At the upper position the forward end of the sucker is positioned adjacent to and directed toward the exposed lower end portion of the under surface of the lowest one of the bills piled on the inclined surface 42 of the tray, so that when suction is applied through the sucking pipe, the lower end portion of the lowest bill is sucked by the pipe and upon clockwise movement thereof the bill is drawn downwardly through the slot. When the sucking pipe has been turned to its lower position, the bill has its lower edge nipped between a pair of rollers 61 and 62. The sucking pipe then releases the bill and is swung back to its upper position. The sucker repeats the above swinging movement thereby removing the bills one after another from on the tray.

The above operation of the sucker is initiated by the set output produced by a flip-flop 55 when the switch 44 is closed by the tray to apply a reset signal to the flip-flop (FIG. 3).

The bill passing the rollers 60 and 61 is then nipped between an endless belt 63 running round three rollers 62 and a drum 64 pressed against the belt 63. After moving along a portion of the circumference of the drum 64, the bill enters a bill checker 66, which comprises an endless belt 69 passing round six rollers 67 and a suction roller 68, a drum 70 having a portion of its circumference pressed againt the belt 69 and guide rollers 71. The bill is sandwiched between the drum 70 and the belt 69 and conveyed along the circumference of the drum as the latter is rotated by means of a motor 71.

Inside the drum 70 and spaced along the circumference thereof there are provided a plurality, say, three magnetic heads (or optical heads) 72 which detect the bill passing by the heads and send the detected information to a memory circuit, not shown, wherein the genuineness, kind and number of the bills are checked and the total value thereof is calculated.

The suction roller 68 is disposed at the outlet end of the bill checker and so arranged that when a suction supplier 80 (FIG. 3) is actuated, the roller 68 sucks and deflects the bill so that it passes between a pair of rollers 81.

The set output from the flip-flop 55 (which is produced upon closure of the switch 44) is applied to an off-delay timer 83, the output of which is applied through an INHIBIT element 84 to the suction supplier 80 to actuate the same. If the bill has been found false by the checker 66, a signal is applied through a terminal P to a monostable circuit 85, the output of which is applied as an inhibit input to the element 84 so as to prevent the operation of the suction supplier 80. As a result, no suction works in the roller 68 so that the bill is not deflected but advances straight along a guide plate 86 and then passes between a belt 88 supported by four rollers 87 and a belt 90 supported by two rollers 89 and then over a guide plate 91 finally to be delivered out onto the tray 17.

The genuine bill that has passed between the rollers 81 is sent into a temporary storage 93 comprising an endless belt 95 horizontally supported by a pair of rollers 94 driven by a motor 97 through a drive belt 98. All the bills that have passed the rollers 81 are piled one upon another on the upper span of the belt 95 to be temporarily stored thereon.

When the last bill on the inclined surface 42 of the tray 15 has been removed therefrom, the light from the lamp 48 passes through the bore 47 to reach the phototransistor 49, whereupoun the flip-flop 55 is reset so that its set output disappears, thereby terminating the operation of the sucker 52. At the same time the input to the timer 83 disappers, but its output continues until the last bill from the tray has been sent out onto the tray 17 or put on the previously piled bills on the belt 95, whereupon the output of the timer 83 disappers so that a roller drive 96 which has until then been driving all the rollers and drums is deenergized.

When all the bills introduced into the machine have been piled on the belt 95, the total value of the bills is indicated in the window 16. The depositor recognizes the indicated value and presses the deposit button 18, whereupon a motor 97 is energized to drive the belt 95 in the direction of an arrow 99 through a belt 98, so that the bills on the belt 95 are collected into a receptacle 100. At the same time a deposit slip or receipt and the card are sent out through the outlet 14.

If the depositor recognizes disagreement between the value indicated in the window 16 and the total value of the bills he has put into the machine, or if he wishes to cancel the deposit, he presses the cancel button 19, whereupon the belt 95 is turned in the opposite direction, so that the bills are all sent out onto the tray 17.

Figure 4:
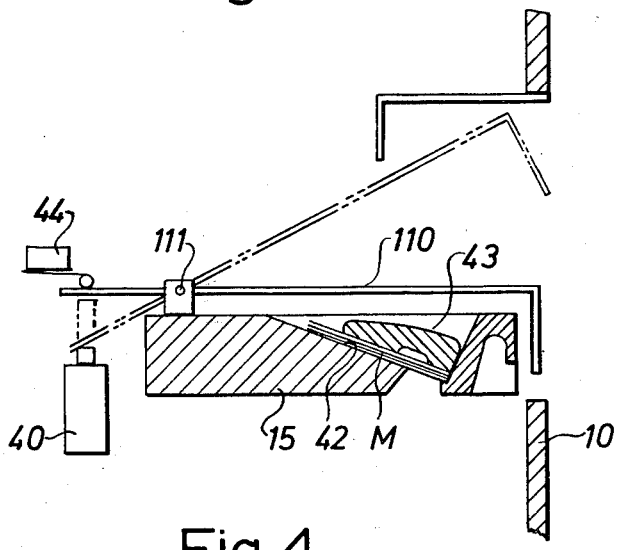
FIG. 4 is a side view of a different form of the bill receiving tray and its associated mechanism.

FIG. 4 shows a modified form of the device for preventing access to the tray 15 from outside the machine housing. The same reference numerals as in FIG. 1 are used here to designate corresponding parts. The device includes a cover plate 110 pivoted at 111 and extending over the upper surface of the tray 15, which in this embodiment is not movable but remains stationary inside the machine housing. The plunger 40a is normally pulled downward by the solenoid 40 so that the cover can be manually opened by the depositor. When the depositor opens the cover and puts the bills M to be deposited on the tray 15 and then closes the cover, the switch 44 is actuated to cause the plunger **40*a* to project upward to the dot-and-dash line position thereby preventing the cover 110 to be opend. When handling of all the bills on the tray have been finished, the plunger 40*a*** is pulled back to its original real-line position.

The apparatus of the invention can be applied to both on-line and off-line depositing systems. In the case of the off-line system it is required that the balance should be recorded on the deposit card. Therefore, whenever a deposit is made, the sum of the value of the money that has now been deposited and the balance till that time is recorded on the card as a new balance. In the case of the on-line system the data from each of the deposit machines in the system are transmitted to a central station so as to be processed in a suitable manner.

What we claim is:

1. A deposit receiving and handling apparatus, comprising:

a first means for receiving from a depositor one or more items to be deposited, said first means including a receptacle means having open and closed conditions, said receptacle means being capable of receiving said items from said depositor only when in said open condition, said first means also including locking means normally maintaining said receptacle means in said closed condition, b second means for receiving from said depositor a card, said second means including validity checking means providing a first output signal when a card so received is valid;

c a third means which is responsive to said first output signal to disable said locking means, whereupon said receptacle means may be operated to its open condition, d fourth means detecting an operation of said receptacle means from said open condition to said closed condition to provide a second output signal, said fourth means additionally being responsive to said second output signal to enable said locking means, e fifth means operable in response to said second output signal to remove said items one at a time from said receptacle means.

2. An apparatus as recited in claim 1, wherein said receptacle means comprises a tray capable of receiving all of said items at one time in a stack, and wherein said first means further includes means permitting movement of said tray in and out of said apparatus, said closed condition of said receptacle means existing when said tray is moved entirely within said apparatus and said open condition of said receptacle means existing when said tray is moved at least partially outside of said apparatus.

3. An apparatus as recited in claim 2, wherein said tray has a surface on which said items are to be placed in a stack, said tray defining an opening in said surface; and wherein said fifth means includes means for sucking said items one at a time through said opening, said apparatus further comprising:

a a second validity checking means, b means for transferring said items one at a time from said sucking means to said second validity checking means, said second validity checking means providing a third output signal whenever an item transferred to it is valid, c means defining an outlet in said apparatus and means providing a temporary storage location in said apparatus, d means operable to transfer said items one at a time back to said depositor through said outlet in the absence of said third output signal, and further operable to transfer said items one at a time to said temporary storage location in the presence of said third output signal;

e means providing a permanent storage location in said housing; and f deposit selection means controlled by said depositor to transfer said items in a stack from said temporary storage location either back to said depositor through said outlet or to said permanent storage location.

4. An apparatus as recited in claim 2, wherein said card has recorded thereon a first secret number, and wherein said first validity checking means includes means reading said first secret number from said card and storing the first secret number so read; keyboard means operable to enter a second secret number known to the depositor and to store the second secret number so entered; comparator means operable to provide said first output signal when said stored first and second secret numbers have a predetermined relationship to each other.

5. An apparatus as recited in claim 2, wherein said card has recorded thereon a first bank number, and wherein said first validity checking means includes means reading said first bank number from said card and storing the first bank number so read; means storing a second bank number; comparator means operable to provide said first output signal when said stored first and second bank numbers are the same.

6. An apparatus as recited in claim 2, wherein said card has recorded thereon a first secret number and a first bank number; and wherein said first validity checking means includes means reading said first secret number and said first bank number from said card and storing the first secret number and the first bank number so read; keyboard means operable to enter a second secret number known to the depositor and to store the second secret number so read; means storing a second bank number; first comparator means operable to provide a first checking signal when said stored first and second secret numbers have a predetermined relationship to each other; second comparator means operable to provide a second checking signal when said stored first and second bank numbers are the same; and, gating means operable to provide said first output signal upon the occurrence of said first and said second checking signal.

7. An apparatus as recited in claim 1, wherein said receptacle means comprises a tray and a cover disposed on said tray and movable between open and closed positions, and wherein said first means further includes means in said apparatus permitting access to said tray and cover, said closed and open conditions of said receptacle means existing when said cover is in said closed and open positions, respectively.

8. An apparatus as recited in claim 7, wherein said tray has a surface on which said items are to be placed in a stack, said tray defining an opening in said surface; and wherein said fifth means includes means for sucking said items one at a time through said opening, said apparatus further comprising:

a a second validity checking means, b means for transferring said items one at a time from said sucking means to said second validity checking means, said second validity means providing a third output signal whenever an item transferred to it is valid, c means defining an outlet in said apparatus and means providing a temporary storage location in said apparatus, d means operable to transfer said items one at a time back to said depositor through said outlet in the absence of said third output signal, and further operable to transfer said items one at a time to said temporary storage location in the presence of said third output signal;

e means providing a permanent storage location in said housing; and f deposit selection means controlled by said depositor to transfer said items in a stack from said temporary storage location either back to said depositor through said outlet or to said permanent storage location.

9. An apparatus as recited in claim 7, wherein said card has recorded thereon a first secret number, and wherein said first validity checking means includes means reading said first secret number from said card and storing the first secret number so read; keyboard means operable to enter a second secret number known to the depositor and to store the second secret number so entered; comparator means operable to provide said first output signal when said stored first and second secret numbers have a predetermined relationship to each other.

10. An apparatus as recited in claim 7, wherein said card has recorded thereon a first bank number, and wherein said first validity checking means includes reading said first bank number from said card and storing the first bank number so read; means storing a second bank number; comparator means operable to provide said first output signal when said stored first and second bank numbers are the same.

11. An apparatus as recited in claim 7, wherein said card has recorded thereon a first secret number and a first bank number; and wherein said first validity checking means includes means reading said first secret number and said first bank number from said card and storing the first secret number and the first bank number so read; keyboard means operable to enter a second secret number known to the depositor and to store the second secret number so read; means storing a second bank number, first comparator means operable to provide a first checking signal when said stored first and second secret numbers have a predetermined relationship to each other; second comparator means operable to provide a second checking signal when said stored first and second bank numbers are the same; and, gating means operable to provide said first output signal upon the occurrence of said first and second checking signals.

* * * * *